US011674656B2

(12) United States Patent
Jun

(10) Patent No.: US 11,674,656 B2
(45) Date of Patent: Jun. 13, 2023

(54) VEHICLE LAMP MODULE

(71) Applicant: HYUNDAI MOBIS CO., LTD., Seoul (KR)

(72) Inventor: Young Geun Jun, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/859,155

(22) Filed: Jul. 7, 2022

(65) Prior Publication Data

US 2023/0010504 A1 Jan. 12, 2023

(30) Foreign Application Priority Data

Jul. 9, 2021 (KR) ..... 10-2021-0090537

(51) Int. Cl.
*F21S 41/25* (2018.01)
*F21S 41/24* (2018.01)
*F21S 41/143* (2018.01)

(52) U.S. Cl.
CPC ..... *F21S 41/25* (2018.01); *F21S 41/143* (2018.01); *F21S 41/24* (2018.01)

(58) Field of Classification Search
None
See application file for complete search history.

(56) References Cited

FOREIGN PATENT DOCUMENTS

EP 2280215 A2 * 2/2011 ..... B60Q 1/04

* cited by examiner

*Primary Examiner* — Elmito Breval
(74) *Attorney, Agent, or Firm* — NovoTechIP International PLLC

(57) ABSTRACT

The present disclosure relates to a vehicle lamp module, and the vehicle lamp module includes a light source device including a substrate and a plurality of light sources mounted on the substrate, a rod device that provides a path through which light generated by the light source device moves and forms a predetermined beam pattern, and a lens device provided so that the light emitted from the rod device is transmitted and discharged to an outside, wherein some of the plurality of light sources are arranged on the substrate in two rows in a longitudinal direction.

10 Claims, 9 Drawing Sheets

VEHICLE LAMP MODULE

CROSS-REFERENCE TO RELATED APPLICATIONS

This application claims the benefit of priority to Korean Patent Application No. 10-2021-0090537, filed in the Korean Intellectual Property Office on Jul. 9, 2021, the entire content of which is incorporated herein by reference.

BACKGROUND

1. Technical Field

The present disclosure relates to a vehicle lamp module, and more particularly, to a vehicle lamp module for securing performance while reducing cost.

2. Discussion of Related Art

Vehicle lamps may be classified into head lamps installed on a front side of a vehicle and tail lamps installed on a rear side of the vehicle. Among them, the head lamps are mounted on left and right sides of the front side of the vehicle and illuminate the front side of the vehicle in a situation such as night driving to secure a front view of a driver.

The head lamps may be classified into a high beam used when the vehicle travels on a road on which there is no oncoming vehicle and a lower beam used in a general road situation other than a situation in which the high beam is used.

Meanwhile, in recent years, a head lamp technology that forms a darkness area in an area in which an opposite vehicle is present when the opposite vehicle approaching from an opposite side is present in conjunction with a sensor technology has been developed.

According to the related art, after a plurality of light sources (for example, light emitting diodes (LEDs)) are installed in the head lamp, light sources that irradiate an area in which the darkness area is to be formed with light are turned off, and thus the darkness area is selectively formed in a partial area.

However, according to the related art, to manufacture a head lamp capable of selectively forming the darkness area and having excellent resolution, excellent light intensity, and excellent uniformity of light brightness, a large number of the light sources need to be installed in the head lamp. This causes a problem of excessively increasing the cost and time required for manufacturing the head lamp. Thus, improvement of the head lamp technology capable of satisfying the resolution, the central light intensity, and the directivity angle to certain levels or more while minimizing the number of light sources is required.

SUMMARY

The present disclosure has been made to solve the above-mentioned problems occurring in the prior art while advantages achieved by the prior art are maintained intact.

An aspect of the present disclosure provides a vehicle lamp module that secures optical performance such as central light intensity to a certain level or more even while a small number of light sources is used.

According to an aspect of the present disclosure, there is provided a vehicle lamp module including a light source device including a substrate and a plurality of light sources mounted on the substrate, a rod device providing a path through which light generated by the light source device moves and configured to form a predetermined beam pattern, and a lens device provided so that the light emitted from the rod device is transmitted and discharged to an outside, wherein some of the plurality of light sources may be arranged on the substrate in two rows in a longitudinal direction.

The plurality of light sources may be divided into a plurality of light source groups arranged on the substrate in a transverse direction and including one or more of the plurality of light sources, and the light sources may be arranged in two rows in at least some of the plurality of light source groups.

Light generated by the plurality of light sources may be emitted to the outside to form a plurality of beam patterns, and when a pair of beam patterns, arranged at both ends in the transverse direction, among the plurality of beam patterns are defined as side beam patterns, and a beam pattern arranged between the pair of side beam patterns is defined as a central beam pattern, the light sources may be arranged in two rows in the longitudinal direction in a light source group forming the central beam pattern among the plurality of light source groups.

The plurality of light sources may be controlled to be turned on or off for each light source group.

The beam patterns formed by the plurality of light source groups may be formed to have different sizes and different quantities of light.

The plurality of light sources may be controlled to be individually turned on or off.

The beam patterns formed by the plurality of light sources may be formed to have different sizes and different quantities of light.

The rod device may include a plurality of rods provided to respectively correspond to the plurality of light sources and having an empty space forming a path through which light generated by the light source moves.

The plurality of rods may be divided into a plurality of rod groups arranged in the transverse direction and including one or more of a plurality of rods, and the rods may be arranged in two rows in at least some of the plurality of rod groups.

The lens device may include an aspherical lens.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described in detail with reference to the accompanying drawings.

First, the embodiments described below are embodiments suitable for understanding technical features of a vehicle lamp module according to the present disclosure. However, the present disclosure is not limited to the embodiments described below, the technical features of the present disclosure are not limited by the described embodiments, and various modifications may be made within the technical scope of the present disclosure.

Figure 1:
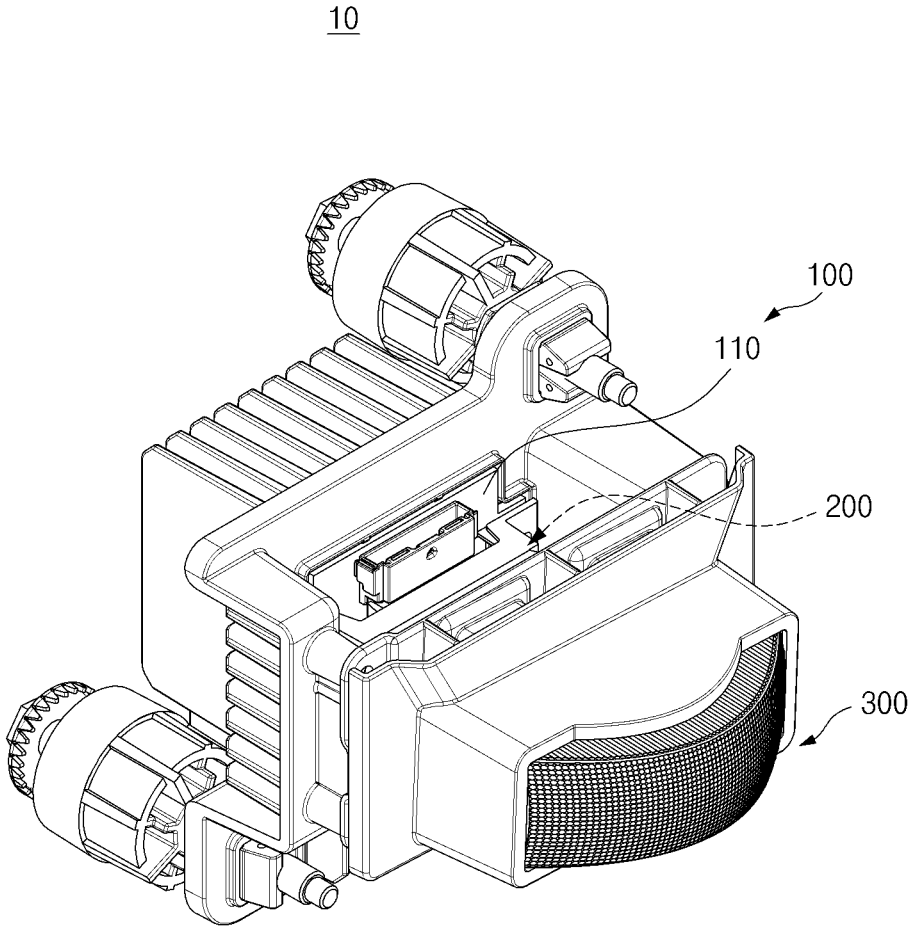
FIG. 1 is a perspective view illustrating a vehicle lamp module according to an embodiment of the present disclosure.
Figure 2:
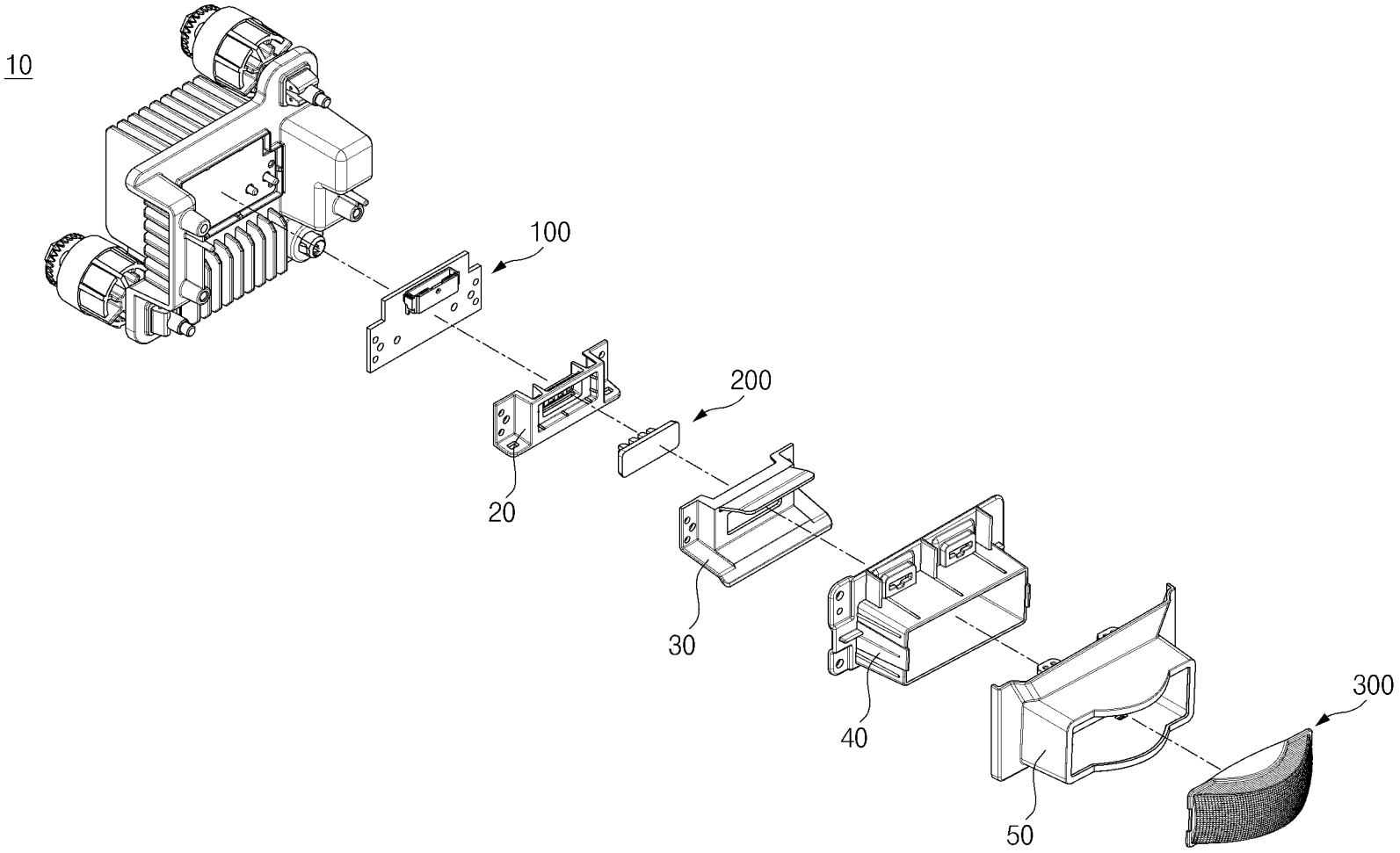
FIG. 2 is an exploded perspective view illustrating a vehicle lamp module according to an embodiment of the present disclosure.
Figure 3:
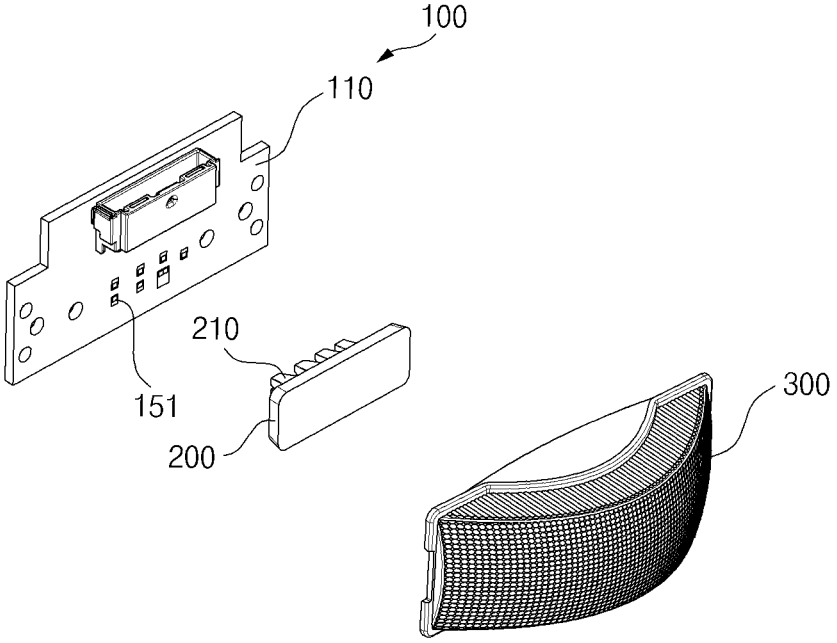
FIG. 3 is a perspective view illustrating a light source device, a rod device, and a lens of the vehicle lamp module according to an embodiment of the present disclosure.
Figure 4:
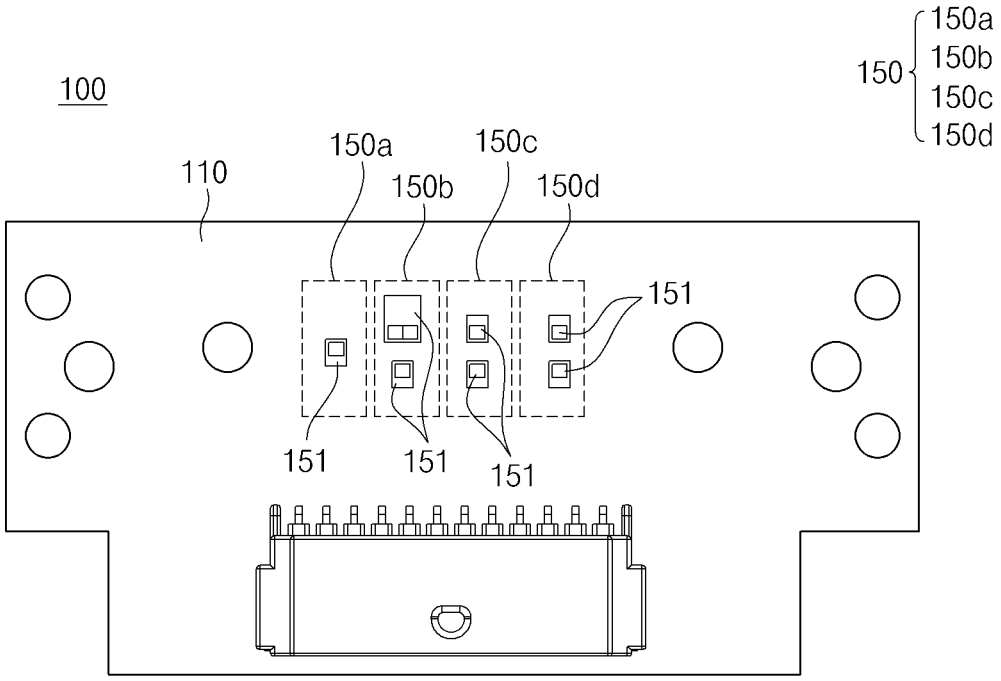
FIG. 4 is a front view illustrating the light source device according to an embodiment of the present disclosure.
Figure 5:
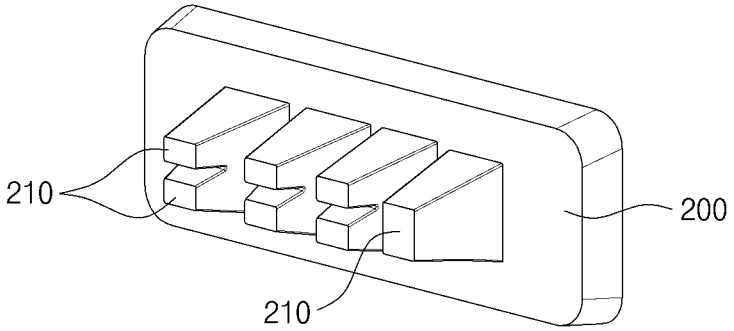
FIG. 5 is a perspective view illustrating the rod device according to an embodiment of the present disclosure.
Figure 6:
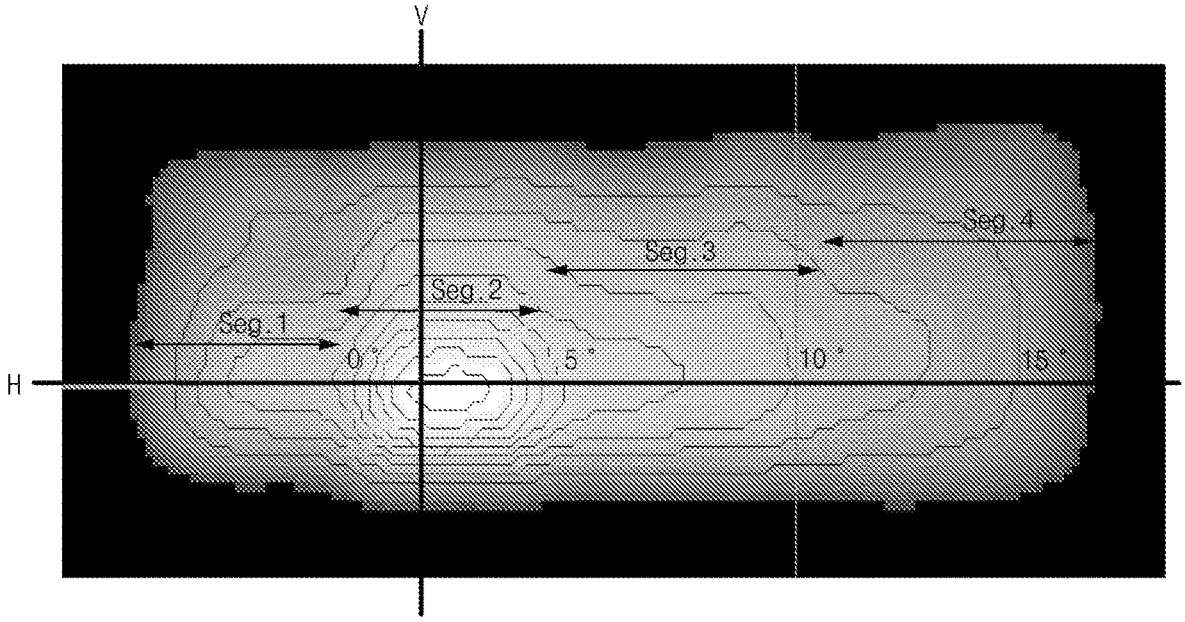
FIG. 6 is a picture illustrating an entire beam pattern formed by the vehicle lamp module according to an embodiment of the present disclosure.
Figure 7A:
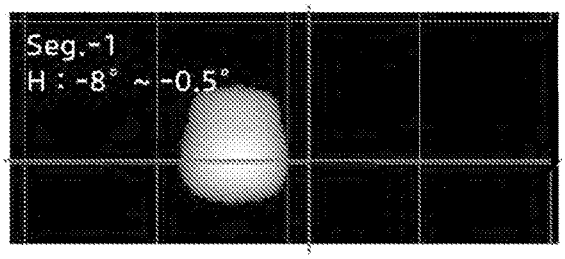
FIGS. 7A, 7B, 7C, and 7D are pictures illustrating individual beam patterns formed by the vehicle lamp module according to an embodiment of the present disclosure.
Figure 7B:
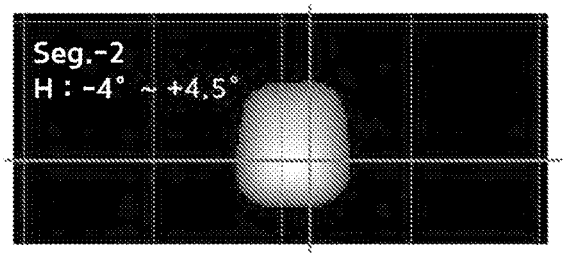
Figure 7C:
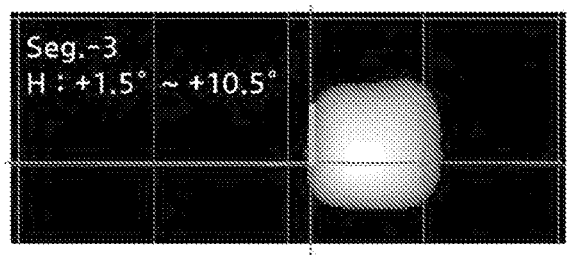
Figure 7D:
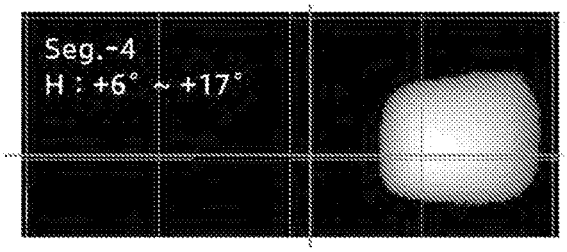
Figure 8:
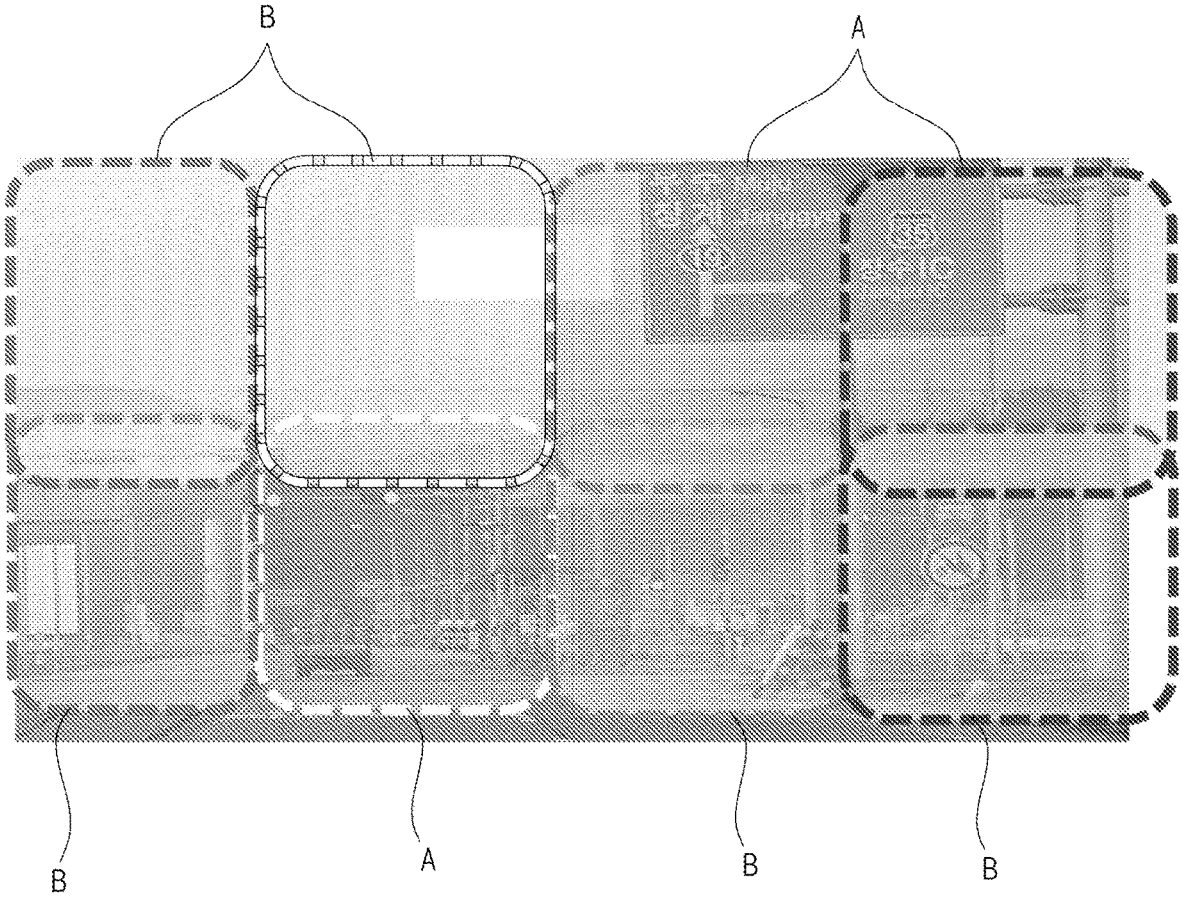
FIG. 8 is an image illustrating a beam pattern formed by the vehicle lamp module according to an embodiment of the present disclosure and for describing an example in which respective light sources are turned on or off.
Figure 9:
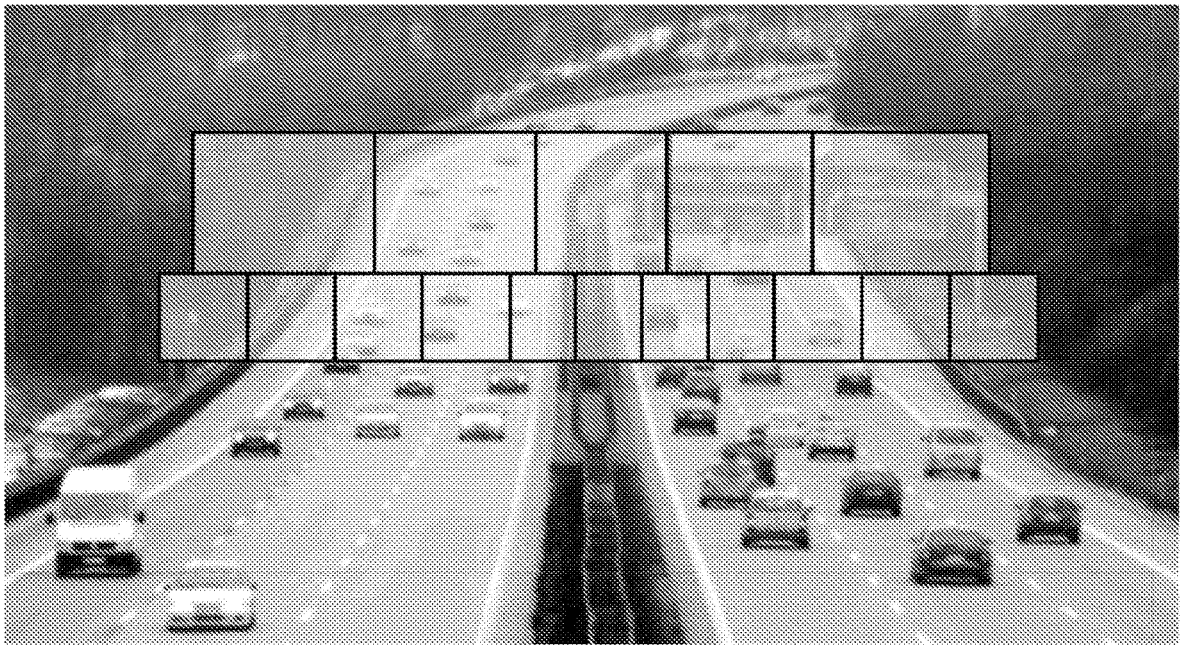
FIG. 9 is an image illustrating a beam pattern formed by the vehicle lamp module according to another embodiment of the present disclosure and for describing an example in which the sizes and light quantities of the individual beam patterns are differently formed.

FIG. 1 is a perspective view illustrating a vehicle lamp module according to an embodiment of the present disclosure, FIG. 2 is an exploded perspective view illustrating a vehicle lamp module according to an embodiment of the present disclosure, FIG. 3 is a perspective view illustrating a light source device, a rod device, and a lens of the vehicle lamp module according to an embodiment of the present disclosure, FIG. 4 is a front view illustrating the light source device according to an embodiment of the present disclosure, FIG. 5 is a perspective view illustrating the rod device according to an embodiment of the present disclosure, FIG. 6 is a picture illustrating an entire beam pattern formed by the vehicle lamp module according to an embodiment of the present disclosure; FIGS. 7A, 7B, 7C, and 7D are pictures illustrating individual beam patterns formed by the vehicle lamp module according to an embodiment of the present disclosure, FIG. 8 is an image illustrating a beam pattern formed by the vehicle lamp module according to an embodiment of the present disclosure and for describing an example in which respective light sources are turned on or off, and FIG. 9 is an image illustrating a beam pattern formed by the vehicle lamp module according to another embodiment of the present disclosure and for describing an example in which the sizes and light quantities of the individual beam patterns are differently formed.

Head lamps may be installed on both sides of the front side of the vehicle, and the head lamps may include a low beam lamp and a high beam lamp. For example, a vehicle lamp module 10 according to the present disclosure may constitute the head lamp and may be high beam lamps provided on the right or left sides. However, the vehicle lamp module 10 according to an embodiment of the present disclosure is not limited thereto and may be applied to various lamps installed in the vehicle.

Referring to FIGS. 1 to 9, the vehicle lamp module 10 according to an embodiment of the present disclosure includes a light source device 100, a rod device 200, and a lens 300.

In the vehicle lamp module 10 according to the present disclosure, a rod inner-bracket part 20, a rod outer-bracket part 30, a lens holder part 40, and a rim cover part 50 may be sequentially assembled. However, a detailed configuration of the vehicle lamp module 10 is not limited to the illustrated embodiment, and a configuration for the assembling may be variously modified.

The light source device 100 includes a substrate 110 and a plurality of light sources 151 mounted on the substrate 110.

For example, the substrate 110 may be provided as a printed circuit board (PCB), and the light sources 151 may be provided as light emitting diodes (LEDs). Light generated from the plurality of light sources 151 may be emitted to the outside to form a plurality of beam patterns.

For example, the substrate 110 may be formed in a plate shape, and some of the plurality of light sources 151 may be arranged on the substrate 110 in a transverse direction. Here, at least some of the plurality of light sources 151 may be arranged on the substrate 110 in two rows in a longitudinal direction (e.g., a first direction). That is, some of the plurality of light sources 151 are arranged below the other light sources 151 (with respect to a direction of the drawings), and thus the at least some of the plurality of light sources 151 may be arranged in two rows. Through this arrangement, even while a small number of the light sources 151 are used, a beam pattern having a targeted light intensity may be secured. Here, to secure uniformity and light intensity performance of the beam pattern formed by the vehicle lamp module 10, the directivity angle of the beam pattern by the light sources arranged in two rows in the longitudinal direction may be designed within an appropriate range.

For example, the light sources 151 arranged in a central area of the substrate 110 may be arranged in two rows, and the light sources 151 arranged in an edge area of the substrate 110 may be arranged in one row or two rows. The light sources 151 arranged in the central area of the substrate 110 may irradiate a central area of the entire beam pattern with light. When the light sources 151 arranged in the central area are arranged in two rows, central light intensity of the entire beam pattern may be sufficiently secured. However, the arrangement of the light sources 151 according to the present disclosure is not limited to the above description.

Meanwhile, the rod device 200 provides a path, through which light generated from the light source device 100 moves or is transmitted, to form a predetermined beam pattern.

In detail, the rod device 200 may include a plurality of rods 210. The plurality of rods 210 may be provided to correspond to the plurality of light sources 151, respectively, and may be provided with an empty space functioning as a path through which the light generated from the light sources 151 moves. The rod 210 may be formed to have an empty space, and may be made of a glass material or a silicone material, but the present disclosure is not limited thereto.

For example, the number of the plurality of rods 210 may be provided to correspond to the light sources 151 and may be arranged at locations corresponding to locations of the light sources 151 during assembling. For example, the plurality of light sources 151 and the plurality of rods 210 may be provided in a one-to-one correspondence.

The light generated by the light sources 151 may be supplied to the rod device 200 and may move through a path formed in the empty space inside each of the rods 210. The light passing through the rods 210 may be supplied to the lens 300. The light passing through each of the rods 210 may form an individual beam pattern, and the individual beam patterns may be collected to form the entire beam pattern.

The lens 300 is provided so that the light emitted from the rod device 200 is externally transmitted therethrough. The light passing through the lens 300 may be externally emitted to form a predetermined beam pattern.

Here, the lens 300 may include an aspherical lens. The aspherical lens is a lens having a focus and may be a lens of which a refractive surface is not a spherical surface but a curved surface. However, the type of the lens 300 is not limited thereto, and various types of lenses may be applied as long as a predetermined beam pattern may be formed through the light incident from the rod device 200.

For example, a vehicle lamp according to an embodiment of the present disclosure may be provided with an adaptive driving beam (ADB) system. The ADB system may automatically adjust a light illumination angle, brightness, a width, and a length of a lamp when an oncoming vehicle or a preceding vehicle is detected while a vehicle travels in a state in which a high beam pattern is formed. Accordingly, glare may not be caused to a driver of the oncoming vehicle or the preceding vehicle, and brightness of a road surface and a sign on a front side, which the driver should identify, may be also maintained.

A matrix type among the ADB is a method in which the plurality of light sources 151 are selectively turned on or off in units of segments so that a darkness area is formed in a space in which the oncoming vehicle or the preceding vehicle is located. Here, the units of segments mean units of the light sources 151 that are individually driven by the light source device 100. The light source device 100 may be controlled to be turned on or off in units of segments. In an embodiment of the present disclosure, the plurality of light sources 151 may be included in the units of segments (see FIGS. 6 and 7) or the one light source 151 may be included in the units of segments (see FIGS. 8 and 9).

First, referring to FIGS. 6 and 7, the plurality of light sources 151 may be arranged on the substrate 110 in the transverse direction (e.g., a second direction traversing the first direction) and may be divided into a plurality of light source groups 150 including at least one of the plurality of light sources 151. Further, in at least some of the plurality of light source groups 150, the light sources 151 may be arranged in two rows.

In detail, the light source groups 150 may be arranged on the substrate 110 in the transverse direction and each of the light source groups 150 may include the one light source 151 or the plurality of light sources 151. In more detail, the one light source group 150 may include the one light source 151 or may include two light sources 151 arranged in two rows in the longitudinal direction.

Here, the plurality of light sources 151 may be controlled to be turned on or off for each light source group 150. That is, the light source group 150 may be the above-described units of segments, that is, units of the individually driven light sources 151. In the present disclosure, since the light source group 150, that is, at least some of the light sources 151 in units of segments, is arranged in two rows in the longitudinal direction, the quantity of light in units of segments may be increased. Accordingly, even while the number of the light sources 151 is reduced, light intensity required in units of segments (that is, units of the light source groups 150) may be secured.

Meanwhile, as described above, the light generated from the plurality of light sources 151 may be emitted externally to form a plurality of beam patterns. Here, among the plurality of beam patterns, a pair of beam patterns arranged at both ends in the transverse direction are defined as a side beam pattern, and a beam pattern arranged between the pair of side beam patterns is defined as a central beam pattern.

In this case, among the plurality of light source groups 150, the light sources 151 included in the light source group 150 forming the central beam pattern may be arranged in two rows in the longitudinal direction. That is, at least the light source group 150 forming the central beam pattern may include the light sources 151 arranged in two rows in the longitudinal direction.

For example, referring to FIG. 4, the light source device 100 may include four groups including a first light source group 150*a*, a second light source group 150*b*, a third light source group 150*c*, and a fourth light source group 150*d* which are sequentially arranged on the substrate 110 in the transverse direction. Further, among them, for example, the first light source group 150*a* arranged at an edge of the substrate 110 may include one light source 151, and the second and third light source groups 150*b* and 150*c* arranged at a central area of the substrate 110 may include the light sources 151 arranged in two rows. However, the number, the location, and the configuration of the light source groups 150 are not limited to the above description.

Accordingly, even while a small number of the light sources 151 are used, the light intensity of the central area of the entire beam pattern may be secured to a certain level or more.

In detail, main performance factors of the vehicle lamp module 10, particularly, the ADB, include resolution, central light intensity, a directivity angle, and the like, which have a close relationship with the number of the light sources 151. That is, when high resolution is required, brightness of the individual beam patterns per light source 151 should be increased, and in this case, the number of the light sources 151 for satisfying the targeted directivity angle is increased. In this case, when a large number of the light sources 151 are arranged densely, the targeted directivity angle may be satisfied, and at the same time, both the resolution and the light intensity may be secured. However, in this case, since a large number of the light sources 151 are required, there may be disadvantages in terms of cost or efficiency.

In the vehicle lamp module 10 according to the present disclosure, the light source group 150 configured as one module and including a small number of the light sources 151 are configured in units of segments, and thus the number of the light sources 151 may be reduced. Further, to compensate for a decrease in the light intensity of the central area of the entire beam pattern as the number of the light sources 151 is reduced, the light sources 151 of the light source group 150 contributing to the light intensity of the central area of the beam pattern are arranged in two rows in the longitudinal direction, and thus the central light intensity may be secured. Accordingly, the present disclosure may improve performance of the lamp to a certain level or more while reducing cost.

Meanwhile, as described above, the plurality of light sources 151 may be controlled to be turned on or off for each light source group 150. For example, when an object such as another vehicle is present in front of the vehicle, the light source group 150 that irradiates an area corresponding to the object with light is turned off, and thus the darkness area may be formed. In contrast, the light source group 150 that irradiates, with light, an area in which there is no object in front of the vehicle is turned on, and thus a light area may be formed.

Here, the beam patterns formed by the plurality of light source groups 150 may be formed to have different light sizes and different light quantities. In detail, the light source group 150 may be provided such that the sizes, the directivity angles, and the light intensities of the individual beam patterns irradiated by the light source group 150 are different according to a usage rate according to an irradiation angle of the vehicle lamp module 10. For example, the number and light quantity of the light sources 151 provided in the one light source group 150 are changed, a distance between the light source groups 150 is adjusted, and thus characteristics of the individual beam patterns may be changed. This may be determined in consideration of a type, a use, a design specification, and the like of the vehicle to which the vehicle lamp module 10 is applied.

Meanwhile, referring FIG. 8, the plurality of light sources 151 may be individually controlled to be turned on or off. Accordingly, for example, in an area in which the light sources 151 are arranged in two rows, the light source 151 in a first row may be turned on and the light sources 151 in a second row may be turned off. In this case, the individual light sources 151 may be provided in the units of segments, that is, the units of individually driven light sources 151. Accordingly, as some light sources 151 are arranged in two rows, while the light intensity of the entire beam pattern is sufficiently secured, the light sources 151 are individually turned on or off as needed, and thus various functions may be implemented.

For example, referring to FIG. 8, the plurality of light sources 151 are arranged in two rows, the light source device 100 is provided such that the light sources 151 are individually turned on or off, and thus a traffic sign recognition (TSR) function may be performed. In detail, when a traffic sign is present in front of the vehicle while the vehicle travels, only the light sources 151 in an area in which the traffic sign is present may be turned on or brightened to form the light" area "A", and the light sources 151 in the other area may be turned off or darkened to form the darkness" area "B". Accordingly, a driver or a camera may accurately recognize the traffic sign, so that the vehicle may stably travel.

Further, the present disclosure is not limited to the implementation of the TSR function, the light sources 151 are individually turned on or off, a front area is subdivided while the vehicle travels, and thus only the light sources 151 in a required area may be turned on or brightened.

Meanwhile, referring to FIG. 9, the beam patterns respectively formed by the plurality of light sources 151 may be formed to have different light sizes and different light quantities. In detail, the light sources 151 may be provided such that the sizes, the directivity angles, and the light intensities of the individual beam patterns irradiated by the light sources 151 are different according to the usage rate according to the irradiation angle of the vehicle lamp module 10. For example, the light intensity and the directivity angle of the one light source group 150 are changed, the distance between the light sources 151 is adjusted, and thus characteristics of the individual beam patterns may be changed. This may be determined in consideration of a type, a use, a design specification, and the like of the vehicle to which the vehicle lamp module 10 is applied. For example, as in the embodiment illustrated in FIG. 9, the directivity angle and the light intensity of the light sources 151 arranged in the first row (an upper row) may be formed to be higher than the directivity angle and the light intensity of the light sources 151 arranged in the second row (a lower row) adjacent to the ground.

Meanwhile, referring to FIG. 5, the plurality of rods 210 may be divided into a plurality of rod groups arranged in the transverse direction and including at least one of a plurality of rods 210. Further, in at least some of the plurality of rod groups, the rods 210 may be arranged in two rows.

In detail, as described above, the plurality of rods 210 provided in the rod device 200 may be provided in the light sources 151, respectively. Thus, when the plurality of light sources 151 constitute the light source group 150, the plurality of rods 210 may constitute the rod group to correspond to the light source group 150.

Thus, when the plurality of light sources 151 constitute the light source group 150, the plurality of rods 210 may form a beam pattern for each rod group.

In contrast, when the plurality of light sources 151 are individually driven, the plurality of rods 210 may be provided to independently form the beam pattern.

According to the vehicle lamp module according to the present disclosure as described above, even while a small number of the light sources are used, optical performance such as the central light intensity may be secured to a certain level or more.

Although specific embodiments of the present disclosure have been described above, the spirit and scope of the present disclosure are not limited thereto, and those skilled in the art to which the present disclosure pertains may derive various modifications and changes without changing the subject matter of the present disclosure described in the appended claims.

What is claimed is:

1. A vehicle lamp module comprising:

a light source device including a substrate and a plurality of light sources disposed on the substrate and configured to generate light;

a rod device configured to transmit the light generated by the plurality of light sources to form a predetermined beam pattern; and a lens configured to externally transmit the light transmitted from the rod device, wherein some of the plurality of light sources are arranged in two rows arranged in a first direction, and wherein a directivity angle and light intensity of the light sources disposed at an upper row of the two rows are greater than those of the light sources disposed at a lower row of the two rows.

2. The vehicle lamp module of claim 1, wherein:

the plurality of light sources is divided into a plurality of light source groups arranged in a second direction traversing the first direction, each light source group including at least one of the plurality of light sources, and at least one of the plurality of light source groups includes the light sources arranged in the two rows.

3. The vehicle lamp module of claim 2, wherein:

the light generated by the plurality of light sources is emitted externally to form a plurality of beam patterns, which includes:

a pair of side beam patterns arranged at both ends of the plurality beam patterns; and a center beam pattern arranged between the pair of side beam patterns, and the light source group forming the central beam pattern includes the light sources arranged in the two rows.

4. The vehicle lamp module of claim 2, wherein the plurality of light sources is controlled to be turned on or off for each light source group.

5. The vehicle lamp module of claim 4, wherein the plurality of beam patterns formed by the plurality of light source groups has different light sizes and different light quantities.

6. The vehicle lamp module of claim 2, wherein the plurality of light sources is controlled to be individually turned on or off.

7. The vehicle lamp module of claim 6, wherein the plurality of beam patterns formed by the plurality of light sources is formed to have different light sizes and different light quantities.

8. The vehicle lamp module of claim 1, wherein the rod device includes a plurality of rods respectively corresponding to the plurality of light sources and having an empty space functioning as the path.

9. The vehicle lamp module of claim 8, wherein:

the plurality of rods is divided into a plurality of rod groups arranged in the second direction, each rod group including at least one of the plurality of rods, and at least some of the plurality of rod groups include the rods arranged in the two rows.

10. The vehicle lamp module of claim 1, wherein the lens includes an aspherical lens.

* * * * *